US008316599B2

(12) United States Patent
Griffiths

(10) Patent No.: US 8,316,599 B2
(45) Date of Patent: Nov. 27, 2012

(54) WALL PANEL SYSTEM WITH SNAP-ON CLIP

(75) Inventor: Robert T. Griffiths, Elk River, MN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 294 days.

(21) Appl. No.: 12/416,271

(22) Filed: Apr. 1, 2009

(65) Prior Publication Data

US 2009/0241456 A1 Oct. 1, 2009

Related U.S. Application Data

(60) Provisional application No. 61/041,431, filed on Apr. 1, 2008.

(51) Int. Cl.
*E04B 1/38* (2006.01)

(52) U.S. Cl. ..... 52/235; 52/506.08; 52/510; 52/512; 52/489.2; 248/222.11; 248/316.7

(58) Field of Classification Search ..... 52/235, 52/506.01, 506.06, 506.08, 510, 512, 489.1, 52/489.2; 24/295, 297, 458; 428/491, 222.11, 428/316.7

See application file for complete search history.

(56) References Cited

U.S. PATENT DOCUMENTS

| | | | | | |
|---|---|---|---|---|---|
| 2,171,221 | A | * | 8/1939 | Maus | 52/474 |
| 2,251,991 | A | * | 8/1941 | Fellner | 52/506.08 |
| 2,317,015 | A | * | 4/1943 | Allen | 52/512 |
| 2,395,726 | A | * | 2/1946 | Del Tufo | 52/509 |
| 2,862,585 | A | * | 12/1958 | McChesney | 52/474 |
| 3,073,420 | A | | 1/1963 | Olsen | |
| 3,378,969 | A | * | 4/1968 | Larger | 52/223.7 |
| 3,936,986 | A | * | 2/1976 | Steel | 52/235 |
| 4,163,445 | A | * | 8/1979 | Stanger | 126/632 |
| 4,344,267 | A | * | 8/1982 | Sukolics | 52/475.1 |
| 4,382,354 | A | * | 5/1983 | Gailey et al. | 52/521 |
| 4,580,385 | A | | 4/1986 | Field | |
| 4,759,157 | A | | 7/1988 | Webb et al. | |
| 4,780,995 | A | | 11/1988 | Gittins | |
| 4,796,403 | A | | 1/1989 | Fulton et al. | |
| 4,798,033 | A | | 1/1989 | Weidl | |
| 4,800,689 | A | | 1/1989 | Lane | |
| 4,829,740 | A | * | 5/1989 | Hutchison | 52/475.1 |
| 4,845,909 | A | * | 7/1989 | Bailey | 52/235 |
| 4,848,045 | A | | 7/1989 | Nichols et al. | |
| 4,890,426 | A | | 1/1990 | Hickman et al. | |
| 4,964,248 | A | | 10/1990 | Braine et al. | |
| 4,969,250 | A | | 11/1990 | Hickman et al. | |
| 5,031,367 | A | | 7/1991 | Butzen | |
| 5,222,341 | A | | 6/1993 | Watkins et al. | |
| 5,239,791 | A | | 8/1993 | Mills, Jr. et al. | |
| 5,251,411 | A | | 10/1993 | Kelley et al. | |
| 5,272,846 | A | | 12/1993 | Kelley et al. | |

(Continued)

*Primary Examiner* — Robert Canfield
*Assistant Examiner* — Brent W Herring
(74) *Attorney, Agent, or Firm* — Jason A. Houser; Arthur M. Reginelli

(57) ABSTRACT

A wall panel system includes at least one wall panel, each edge of the panel having a flange. At least one flange, and preferably two opposing flanges, have at least one slot therein. Each slot is mated with a clip having two extensions laterally spaced from one another, one of said extensions having a latch member protruding in a direction toward the other of said extensions, such that the clip is secured to the flange by virtue of the latch member mating with the slot. The clip may then be attached to a building surface or intermediary mounting apparatus by a fastener to secure the wall panel thereto.

12 Claims, 5 Drawing Sheets

U.S. PATENT DOCUMENTS

| | | | | |
|---|---|---|---|---|
| 5,289,662 | A | 3/1994 | Castle | |
| 5,414,965 | A | 5/1995 | Kelley et al. | |
| 5,414,971 | A * | 5/1995 | Handte | 52/506.06 |
| 5,493,831 | A * | 2/1996 | Jansson | 52/235 |
| 5,544,461 | A * | 8/1996 | Sommerstein | 52/235 |
| 5,809,729 | A * | 9/1998 | Mitchell | 52/474 |
| 5,893,247 | A | 4/1999 | Hickman et al. | |
| 5,927,023 | A | 7/1999 | Kittilstad | |
| 6,035,598 | A * | 3/2000 | Sukolics et al. | 52/506.08 |
| 6,216,408 | B1 | 4/2001 | Davidson | |
| 6,330,772 | B1 * | 12/2001 | Mitchell et al. | 52/235 |
| 6,434,853 | B2 | 8/2002 | Pyburn | |
| 6,442,904 | B1 | 9/2002 | Ortiz | |
| 6,578,322 | B2 | 6/2003 | Kintop | |
| 6,606,828 | B1 | 8/2003 | Lin et al. | |
| 6,745,527 | B1 * | 6/2004 | Sherman et al. | 52/235 |
| 6,786,018 | B2 | 9/2004 | Webb et al. | |
| 6,845,590 | B1 | 1/2005 | Mills, Jr. | |
| 6,887,551 | B2 * | 5/2005 | Hyde et al. | 428/99 |
| 6,912,813 | B2 | 7/2005 | Grizenko | |
| 6,912,814 | B1 | 7/2005 | Inzeo | |
| 6,945,005 | B2 | 9/2005 | Nunley | |
| 7,059,086 | B2 | 6/2006 | Edvardsen | |
| 7,614,191 | B2 * | 11/2009 | Mitchell | 52/235 |
| 7,735,287 | B2 * | 6/2010 | Gaudreau | 52/526 |
| 7,805,815 | B2 * | 10/2010 | Babian et al. | 24/295 |
| 2004/0134143 | A1 * | 7/2004 | Boyer | 52/235 |

* cited by examiner

WALL PANEL SYSTEM WITH SNAP-ON CLIP

This application gains the benefit of U.S. Provisional Application No. 61/041,431 filed Apr. 1, 2008, which is incorporated herein by reference.

FIELD OF THE INVENTION

One or more embodiments of this invention relate to an architectural wall panel system designed to cover an interior or exterior building surface. More particularly, one or more embodiments of this invention relate to an architectural wall panel system with an attachment system having snap-on clips to connect the wall panels to a mounting rail attached to the building surface, the attachment system allowing for thermal cycling of the architectural wall panel system.

BACKGROUND OF THE INVENTION

Architectural wall panel systems, including both metal and composite wall panel systems, have been used extensively for some time, primarily in the commercial and industrial building markets. In recent years, the popularity of composite wall panel systems, in particular, has been increasing steadily. There are a number of factors that may be credited for the wide-spread and increased use of such wall panel systems. One such factor is the high cost to construct commercial and industrial buildings, which tend to be relatively large from stone or brick. Wood is not a suitable substitute due to the large loads the buildings supporting structure must withstand. Another factor effecting the increased use of metal and composite wall panel systems is the high durability of the systems. Both the metals and composites used to make the panels for wall panel systems are highly resistant to damage from sun, dirt, moisture, fire, and many other environmental elements. Consequently, the metal and composite wall panel systems have a long life, and may require less maintenance than other alternative building materials and systems.

Architectural wall panel systems can generally be placed into one of two categories: face-sealed architectural panel systems or vented rain-screen architectural panel systems. Face-sealed architectural panel systems include those systems that have a sealant in both the horizontal and vertical joints between adjacent wall panels. The sealants make the wall panel system impermeable to air and water, and may include caulking, gaskets, or other sealants with a similar function. Vented rain-screen architectural panel systems are those systems designed to allow permeability through the joints between adjacent wall panels. The permeable joints allow for breathability and rapid pressure equalization within the wall panel system to prevent pressure buildups behind the panels.

Architectural wall panel systems have many advantages, as discussed above, however, these systems may also present a number of challenges and disadvantages. One such challenge is the thermal expansion and contraction of the wall panels. The metal and composite materials used most commonly in architectural wall panel systems are subject to natural expansion and contraction due to changes in atmospheric conditions, including heat and humidity. If a means of accommodating this inherent thermal cycling is not provided in the attachment system of the architectural wall panel system, then the panels can become warped and cracked, requiring repair work or replacement. A second challenge that may be associated with architectural wall panel systems is directly related to the first issue of thermal cycling, and relates to the effectiveness of sealants used in joints between adjacent wall panels in face-sealed architectural panel systems. Because the joints increase and decrease in size during thermal cycling, sealants often become dislodged and/or cracked and are thereafter ineffective at preventing the infiltration of air and water. As a result, sealants used in face-sealed architectural panel systems have proven disappointingly ineffective.

Another disadvantage associated with many architectural wall panel systems is the complexity of the system, including the number of pieces and parts needed and the extensive time and labor required to install the complex system. In particular, where a form of attachment clips are used to secure the wall panels to the substructure, each clip must typically be fastened to the wall panel and to the substructure, either directly or indirectly. This means that if an extremely high number of fasteners are used, it results in a great deal of time and effort spent in installation of the systems just to secure the clips to the panels prior to attaching the panels to the structure.

A number of different attachment systems have been introduced and employed in an attempt to overcome the challenges and alleviate the disadvantages discussed above. One known attachment system includes a plurality of locking members secured directly to, or formed integrally with, the outer surface of the return flanges of wall panels. The locking members secure the panel to a retaining member, which is itself secured to a surface of a building structure. The locking members are shaped such that they may be forced into a channel, but cannot be removed from that channel, such as angled surfaces with an apex adjacent the retaining member that resemble half of an arrowhead. The system may also optionally provide a drainage channel to carry water and other debris away from the surface of the building structure. While this attachment system allows for more efficient installation of an architectural wall panel system, it suffers from the disadvantage mentioned above relating to thermal cycling of the wall panel system because it does not allow for movement of the wall panels. In addition, the attachment system suffers from a number of new disadvantages, such as not providing adequate attachment strength to withstand some natural weather conditions, and making it extremely difficult to repair or replace installed wall panels as the locking members prevent the panel from being removed from the retaining members.

Other known attachment systems for securing wall panels of an architectural wall panel system to a building surface utilize some form of an insert wedged between the two adjacent flanges of adjacent wall panels, while the flanges are received in a channel. The insert is secured between the two flanges by a fastener, and fits snuggly therebetween to provide a seal against water and air infiltration. The insert may be made of an elastomeric material to allow for thermal expansion and contraction of the wall panels. This system, however, uses a high number of parts, and the thermal cycling of the system is limited by the small amount of movement allowed by the elastomeric insert. Furthermore, the elastomeric insert is subject to wear from the natural elements it will be exposed to, and subject to failure due to these elements and repeated expansion and contraction as a result of the thermal cycling of the wall panel system.

Additional attempts at improved attachment systems have included attachment systems utilizing variously shaped flanges extending along at least one edge of the wall panel to facilitate attachment of the panel to a building surface; attachment systems using rotatable retaining members secured to the mounting surface that rotate between a first (narrow) position designed to allow placement of the wall panels and a second (broad) position extending into slots in the wall panel flange to secure the panel in place, such as, for example, a T-shaped retaining member that rotates about an axis parallel to the wall panel flanges; and attachment systems having vents and filler strips which slide into grooves and are positioned within the gaps between adjacent wall panels to provide a watertight seal while allowing air flow therethrough. None of these attachment systems has proven noticeably advantageous over conventional attachment methods in providing a more efficient, reliable, and practical means of attaching architectural wall panels to the surface of a structure.

There is therefore a need for an improved architectural wall panel system, and specifically an improved attachment system for attaching architectural wall panels, that alleviates one or more of the disadvantages discussed herein.

DETAILED DESCRIPTION OF ILLUSTRATIVE EMBODIMENTS

Figure 1:
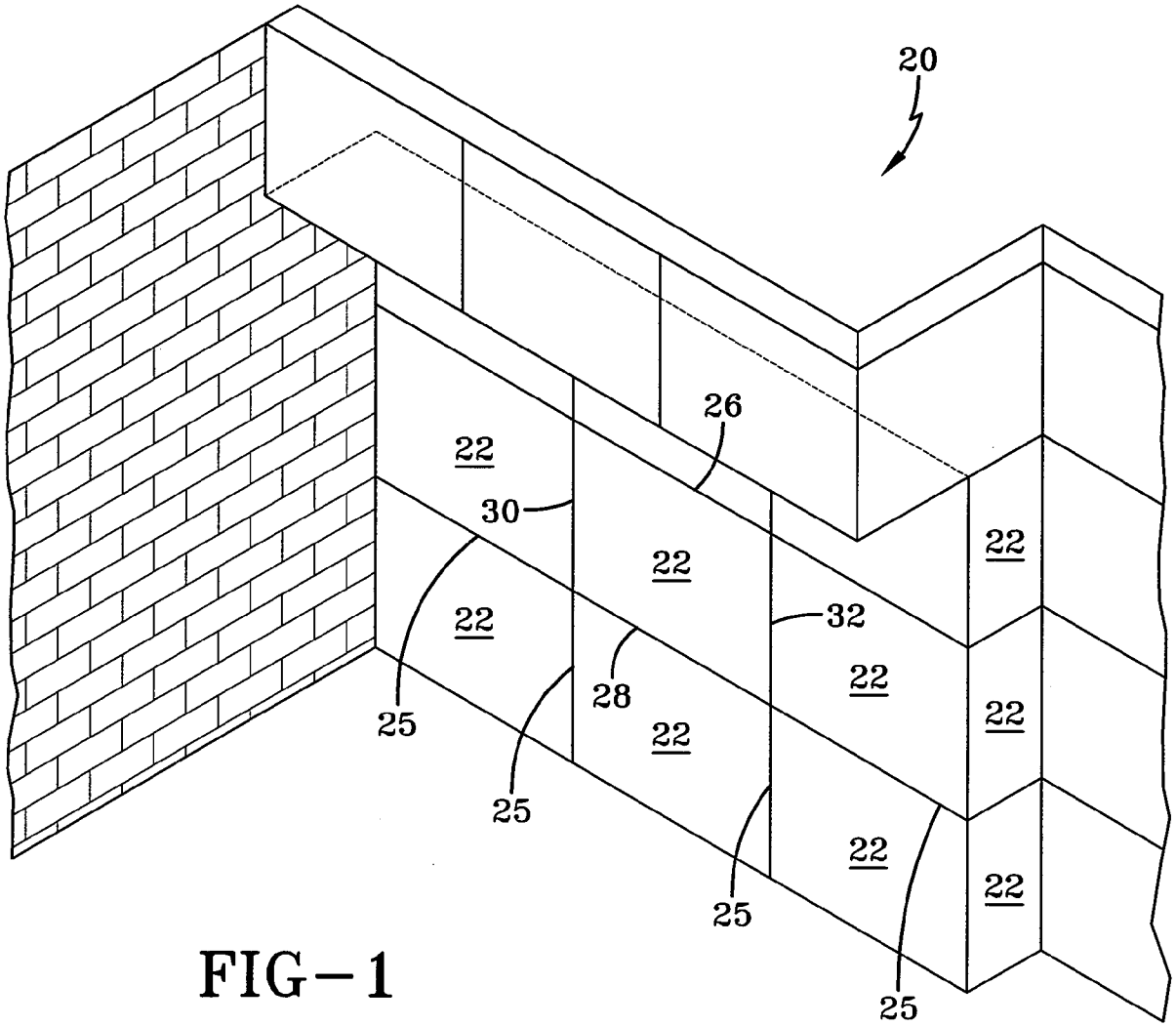
FIG. 1 is perspective view of a wall panel system installed on an exterior building surface according to the concepts of the present invention.
Figure 2:
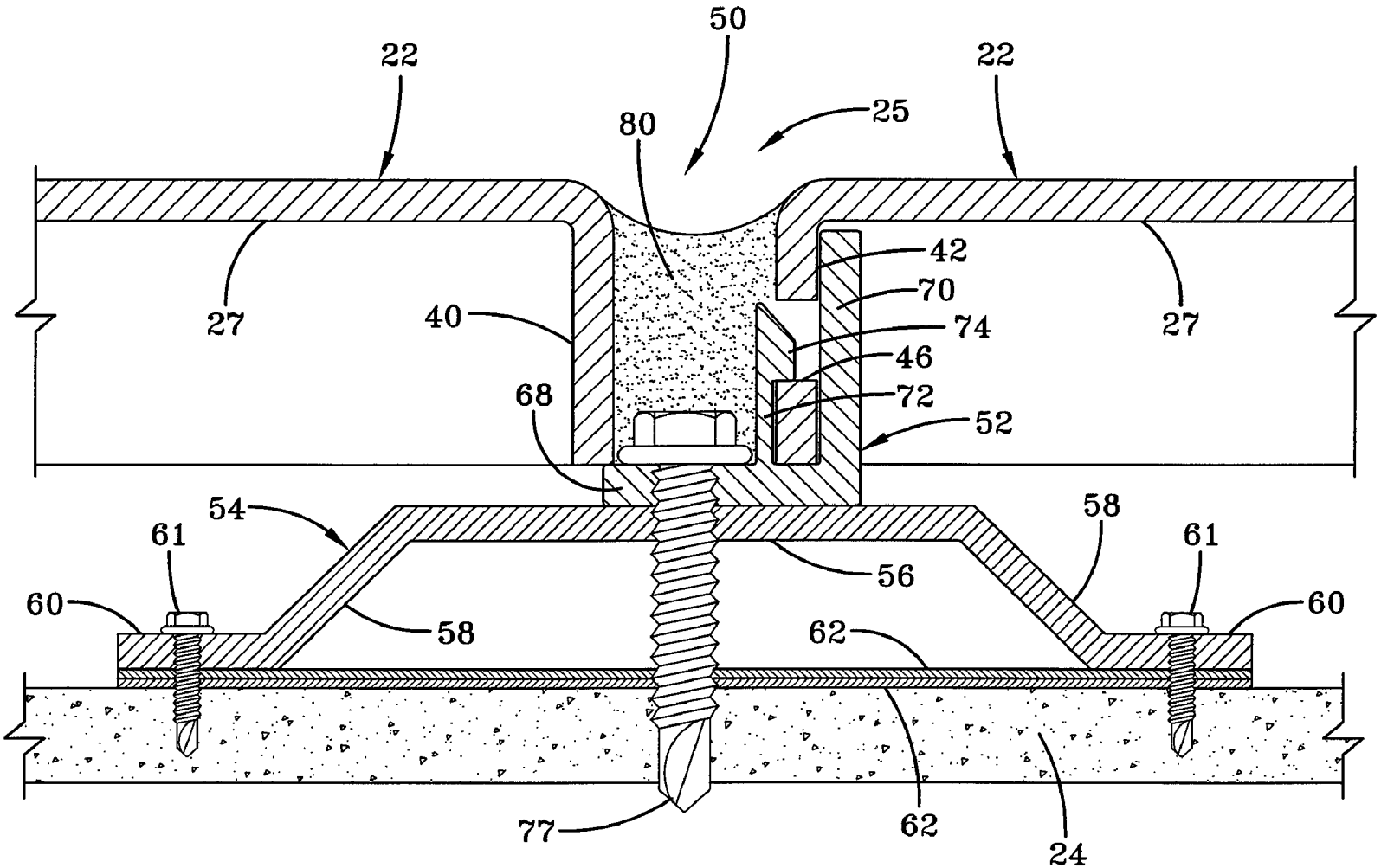
FIG. 2 is a cross section view of a portion of the wall panel system of FIG. 1.
Figure 4:
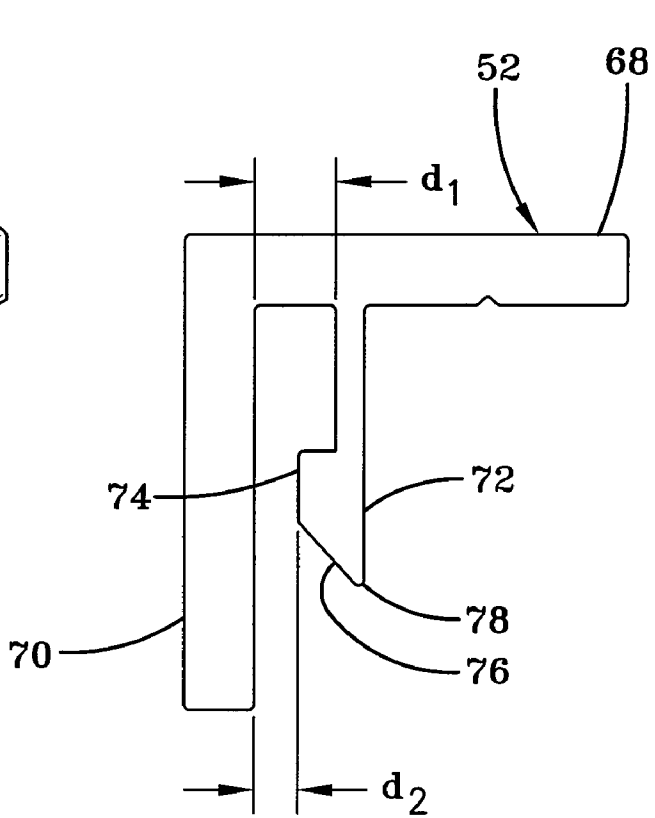
FIG. 4 is a side elevational view of the clip of FIG. 3.
Figure 3:
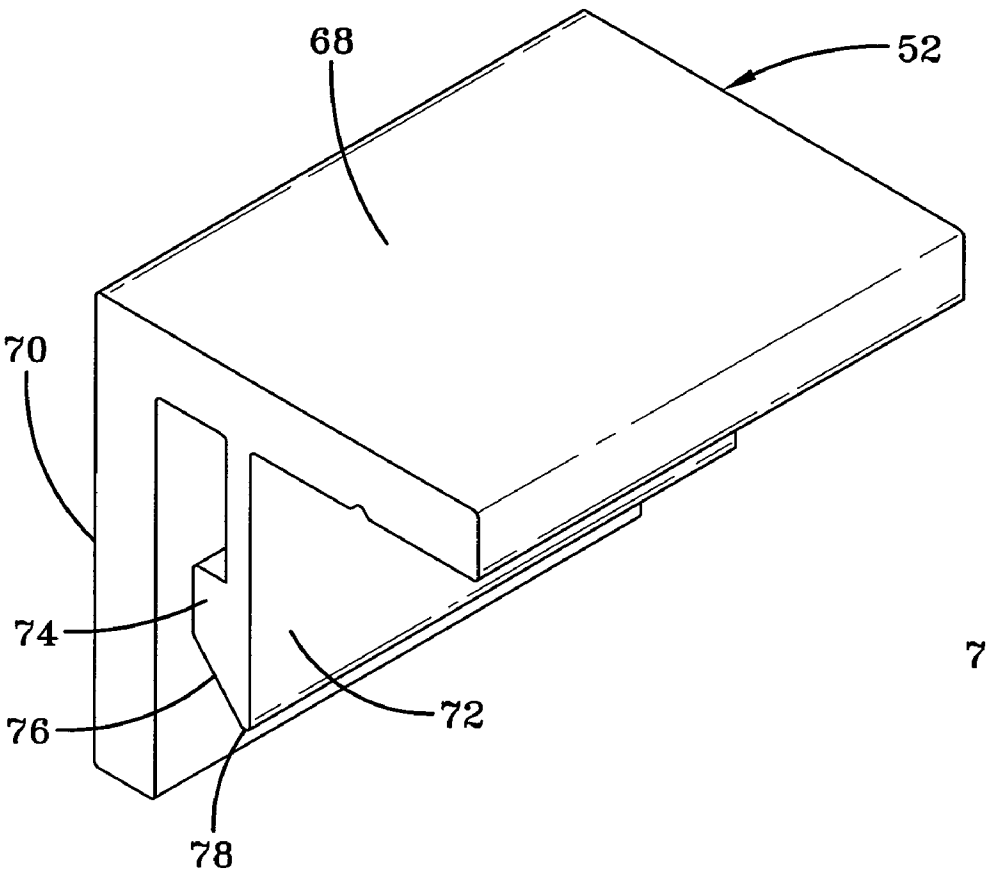
FIG. 3 is a perspective view of a clip of the attachment system for the wall panels according to the concepts of the present invention.
Figure 5:
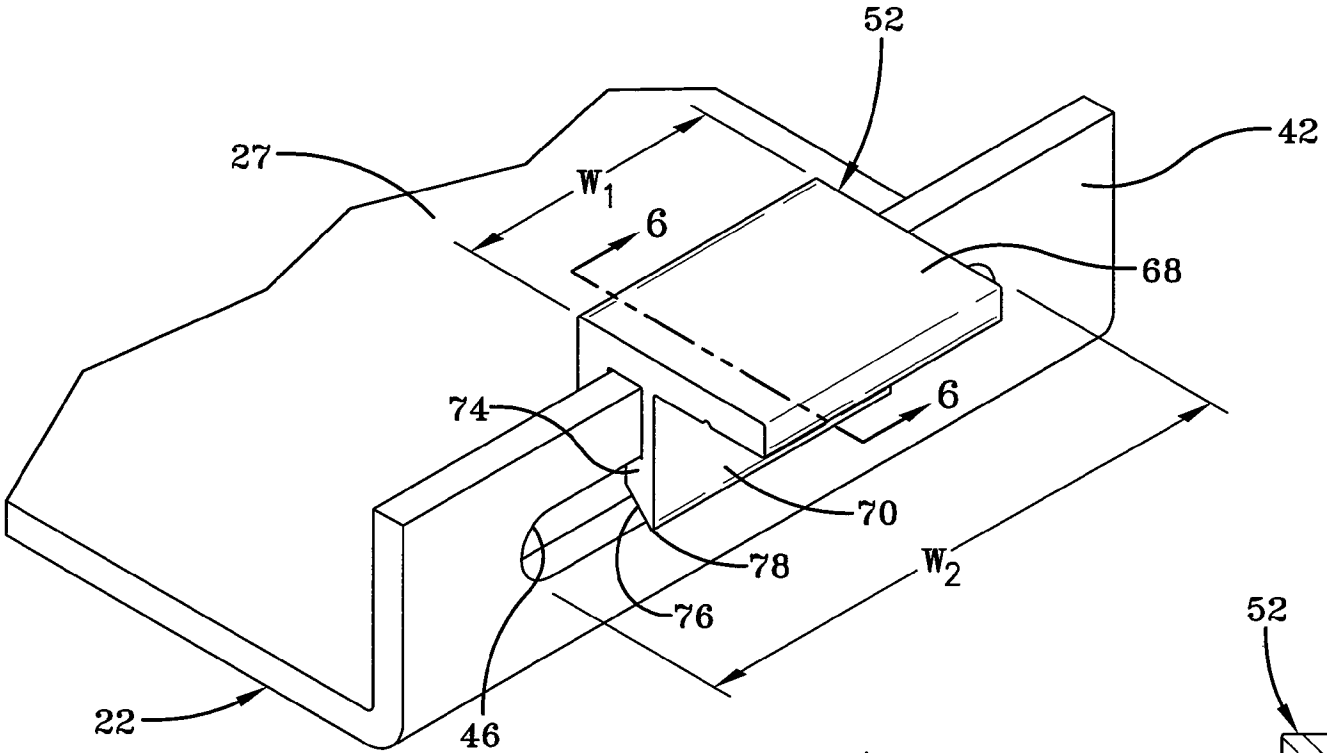
FIG. 5 is a perspective view of a clip attached to a wall panel flange according to the concepts of the present invention.
Figure 6:
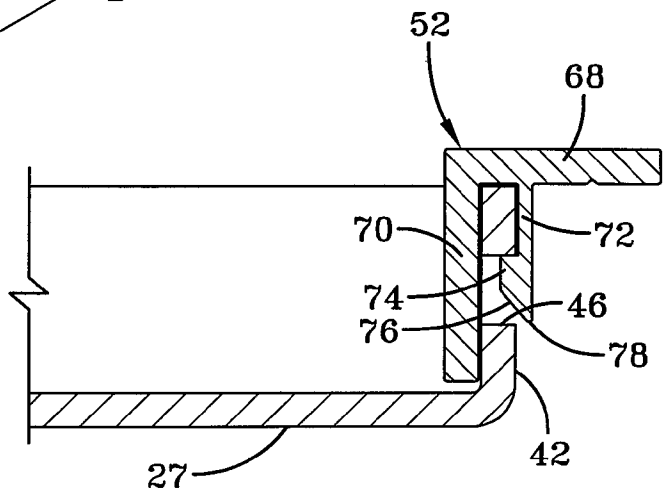
FIG. 6 is a side view of the clip and panel flange taken substantially along the line 6-6 of FIG. 5.

In one or more embodiments of the present invention an architectural wall panel system (hereinafter referred to as wall panel system) is provided, and is generally indicated by the numeral 20 in FIG. 1. With reference to FIG. 2, an exemplary wall panel system 20 is shown as installed on a building surface 24 (FIG. 2). Wall panel system 20 includes a plurality of wall panels 22 positioned adjacent to one another on a surface, such as building surface 24. While reference will be made herein to building surface 24, it should be appreciated that wall panel system 20 may be used on any desired surface, whether interior or exterior, and reference to building surface 24 should not be interpreted as limiting the scope of the invention.

Wall panels 22 may be made of any suitable material. In one or more embodiments wall panels 22 may have strength and wear characteristics sufficient to be able to withstand the natural forces and elements that act upon wall panel systems 20 mounted to an exterior building surface. Such materials will be readily apparent to a person of ordinary skill in the art. In one or more embodiments wall panels 22 may be made of metal, and in a preferred embodiment wall panels 22 are made of aluminum. In another embodiment, wall panels 22 may be made of a composite material. Wall panels 22, as shown in the figures, have a rectangular shape, however other shapes may be employed without deviating from the scope of the invention. Wall panels 22 are positioned adjacent to one another with a gap, generally indicated by the numeral 25, therebetween to facilitate installation and thermal cycling, as will be discussed in greater detail below.

Each wall panel 22 has a top edge 26, a bottom edge 28, and left side edge 30, and a right side edge 32. Gaps 25 are formed between the adjacent edges of two panels, such as, for instance, a horizontal gap 25 between top edge 26 of a lower panel and bottom edge 28 of an upper panel positioned immediately above the lower panel. Similarly, vertical gaps 25 are formed between a left side edge 30 and a right side edge 32 of adjacent panels. As is apparent from FIG. 1, wall panel system 20 may be adapted to be used to cover inside and outside corners, soffits, copings, window peripheries, and other architectural features that may be present on building surface 24. In one or more embodiments the adaptation of wall panel system 20 to the architectural features of building surface 24 may be accomplished by varying the dimensions of wall panels 22. Thus, in at least one embodiment of the invention, wall panels 22 may be of different shapes and sizes as needed to properly cover building surface 24.

In one or more embodiments wall panel 22 is generally pan shaped having a body portion 27 (FIG. 2) and side portions, also referred to as side flanges or flanges, extending from the edges of body portion 27. The side flanges of wall panel 22 extend a relatively short distance from body portion 27, as compared with the overall dimensions of wall panel 22. The flanges extend from each edge so that top edge 26, bottom edge 28, left side edge 30, and right side edge 32 each has a flange extending therefrom. FIG. 2 depicts a left side flange 40 and a right side flange 42 of adjacent panels 22. In one or more embodiments the flanges may be connected at the corners of body portion 27, and in other embodiments a gap may exist between adjacent flanges at the corners of body portion 27. The flanges have an inner surface facing the center of body portion 27, and an outer surface facing away from the center of body portion 27. Slots 46 may be provided in one or more of the flanges of panel 22, as shown in right side flange 42 in FIG. 2.

Body portion 27 may have any desired size, depending upon the desired appearance of wall panel system 20 and the engineering design constraints relating to wind forces and other such factors that may limit the dimensions of wall panel 22 in one or more ways. In one or more embodiments, such as the embodiment shown in the figures having a rectangular shaped wall panel 22, body portion 27 may have a height, or distance between top edge 26 and bottom edge 28, of, for example, between approximately 3 inches and 72 inches, in other embodiments between approximately 6 inches and 60 inches, and in still other embodiments between 6 inches and 48 inches. Similarly, body portion 27 may have a width, or distance between left side edge 30 and right side edge 32, of between approximately 3 inches and 180 inches, in other embodiments between approximately 6 inches and 144 inches, and in still other embodiments between 6 inches and 120 inches. The height and width of body portion 27 may differ, creating a rectangular shaped body portion 27, or they may be equal, thereby making body portion 27 square in shape.

In one or more embodiments wall panel 22 may have a depth of between approximately 0.5 inches and 6 inches, in other embodiments a depth of between 0.5 and 3 inches, and in a preferred embodiment a depth of approximately 0.875 inches. Wall panel 22 may also include one or several of a variety of finishes or textures to provide a desired appearance, as is well known in the art.

In one or more embodiments slots 46 are included in one pair of opposing flanges of wall panel 22, typically the longer side of wall panel 22. For example, if wall panel 22 is wider than it is tall, then top flange 36 and bottom flange 38 will include slots therein and left side flange 40 and right side flange 42 will not. Conversely, if wall panel 22 is taller than it is wide, then left side flange 40 and right side flange 42 will include slots therein and top flange 36 and bottom flange 38 will not. In the case of a substantially square wall panel 22, slots may be provided in either pair of opposed flanges. The sizing and spacing of slots 46 may depend upon the specific constraints of an attachment system 50 used to attach wall panel 22 to building surface 24. In one or more embodiments each wall panel flange having slots 46 includes at least three slots 46 to allow for proper attachment to building surface 24, as will be discussed in greater detail hereinafter. In other embodiments, particularly where wall panels 22 are relatively large in size, more than three slots 46 may be provided per flange.

The attachment system 50 used to secure wall panels 22 to building surface 24 is best shown in FIG. 2. Although a vertical joint is shown, it should be appreciated that wall panels 22 with slots 46 in their horizontal flanges are attached in a similar manner, except that the components of the attachment system 50 are reoriented. In one or more embodiments of the attachment system 50, such as that shown in FIG. 2, a plurality of clips, generally indicated by the numeral 52, secure wall panel 22 to a mounting rail, generally indicated by the numeral 54, attached to building surface 24.

Mounting rails 54 include a planar surface 56 that is generally parallel to building surface 24, and a pair of legs 58 extending between planar surface 56 and building surface 24. Mounting rails 54 also include a pair of mounting flanges 60, each mounting flange 60 extending outwardly from an end of a leg 58 opposite planar surface 56. Mounting rails 54 extend longitudinally along building surface 24 in either a generally horizontal or generally vertical orientation, depending upon the location of slots 46 on panels 22. Other mounting rails 54 are positioned similarly at the perpendicular joints between adjacent wall panels 22 throughout wall panel system 20. Mounting rails 54 are secured to building surface 24 by a plurality of fasteners 61 through mounting flanges 60. Fasteners 61 may be any conventional fasteners known to those skilled in the art. In a preferred embodiment, fasteners 61 extending are self-tapping fasteners so that they may be installed through mounting flanges 50 and building surface 24 without the need for pre-drilling holes.

In one or more embodiments shims 62 are provided between building surface 24 and mounting rail 54, with fasteners 61 being driven therethrough. Shims 62 are used to ensure that wall panels 22 are kept plumb, due to the reality that most building surfaces 24 are not plumb when finished. While the preferred embodiment shown in the figures and discussed herein includes mounting rails 54 as described above, it should be appreciated that such mounting rails 54 may have a different shape or orientation, and in some cases may not be necessary at all. In cases where mounting rails 54 are used, it is only necessary that the rails be secured to building surface 24 and that they provide a mounting surface for clips 52. For instance, in other embodiments, and as discussed above, identical mounting rails 54 may extend in a generally horizontal orientation beneath the horizontal joints between adjacent wall panels 22, as opposed to the vertical joints, to allow attachment of wall panels 22 to building surface 24. Alternatively, in still other embodiments, wall panel 22 may be attached to building surface 24 through clips 52 without the use of any intermediary mounting rails 54, and instead secured to building surface 24 directly by a fastener 77 through clip 52.

A plurality of clips 52 are provided to secure wall panel 22 to mounting rail 54, or, alternatively, directly to building surface 24. Clips 52 are designed to be secured to panels 22 by an attachment mechanism included thereon, as opposed to the conventional method of using fasteners, such as rivets, to secure clips 52 to wall panels 22. Clips 52, as best seen in FIGS. 3-6, have a fastening plate 68 with a first extension 70 and a second extension 72 extending therefrom and laterally spaced from one another. Fastening plate 68 may have any desired width, but in one or more embodiments may be within the range of approximately 0.5 inches to 1.5 inches. First extension 70 may extend from an edge of fastening plate 68, and second extension 72 is spaced from first extension 70 by a distance $d_1$ greater than the thickness of the flanges of panel 22. Extensions 70 and 72 may be of equal or different lengths, but in either case are both shorter than the flanges provided on wall panel 22 to be used in conjunction therewith. The laterally spaced extensions 70 and 72 may be substantially parallel and are in any instance designed to allow a flange of wall panel 22 to slide therebetween.

In one or more embodiments, second extension 72 includes a latch member 74 protruding therefrom in a direction towards first extension 70. Latch member 74 is spaced from first extension 70 by distance $d_2$ that is less than the thickness of the flange of wall panel 22. In one or more embodiments latch member 74 may have an angled surface 76 relative to second extension 72, creating a triangular cross section, with an apex 78 of the angled surface 76 of latch member 74 and the surface of second extension 72 being located on the side of latch member 74 opposite fastening plate 68. In one or more embodiments, at least second extension 72 may be resilient to deflect away from first extension 70, thereby allowing latch member 74 to move to temporarily increase the distance $d_2$. Second extension 72 is adapted to then return to its static position due to its resilient nature. As a result of the shape and orientation of latch member 74, and the resilient nature of second extension 72, clip 52 may be pushed over a flange of wall panel 22 with extensions 70 and 72 on opposite sides of the flange.

If clip 52 and the flange 42 are properly aligned, latch member 74 will snap into a slot 46 due to the resiliency of second extension 72, thereby securing clip 52 to wall panel 22 by virtue of the distance $d_2$ between latch member 74 and first extension 70, and the shape of latch member 74. Clips 52 are mated with the flanges of wall panel 22 with first extension 70 positioned proximate the inner portion of wall panel 22, and second extension 72 positioned proximate the outer surface of wall panel 22, and with part of fastening plate 68 extending outwardly from wall panel 22. In other embodiments, clip 52 may be further provided with a second latch member 74 on first extension 70 protruding inwardly towards the other latch member 74 on second extension 72. Such a clip 52 having two latch members 74 functions in the same way as the clip 52 described above.

In one or more embodiments slots 46 in the wall panel flanges may be made longer than clips 52 to allow for thermal cycling of wall panel system 20. For example, in one embodiment clips 52 may have a width $w_1$ of approximately 1.0 inches, and slots 46 may have a corresponding width $w_2$ of approximately 2.0 inches. The additional width provided by slots 46, along with the design of clips 52, which do not require fasteners effecting rigid attachment to wall panels 22, allows wall panel system 20 to expand and contract as dictated by temperatures and other natural conditions without suffering from deleterious deformation.

Figure 7:
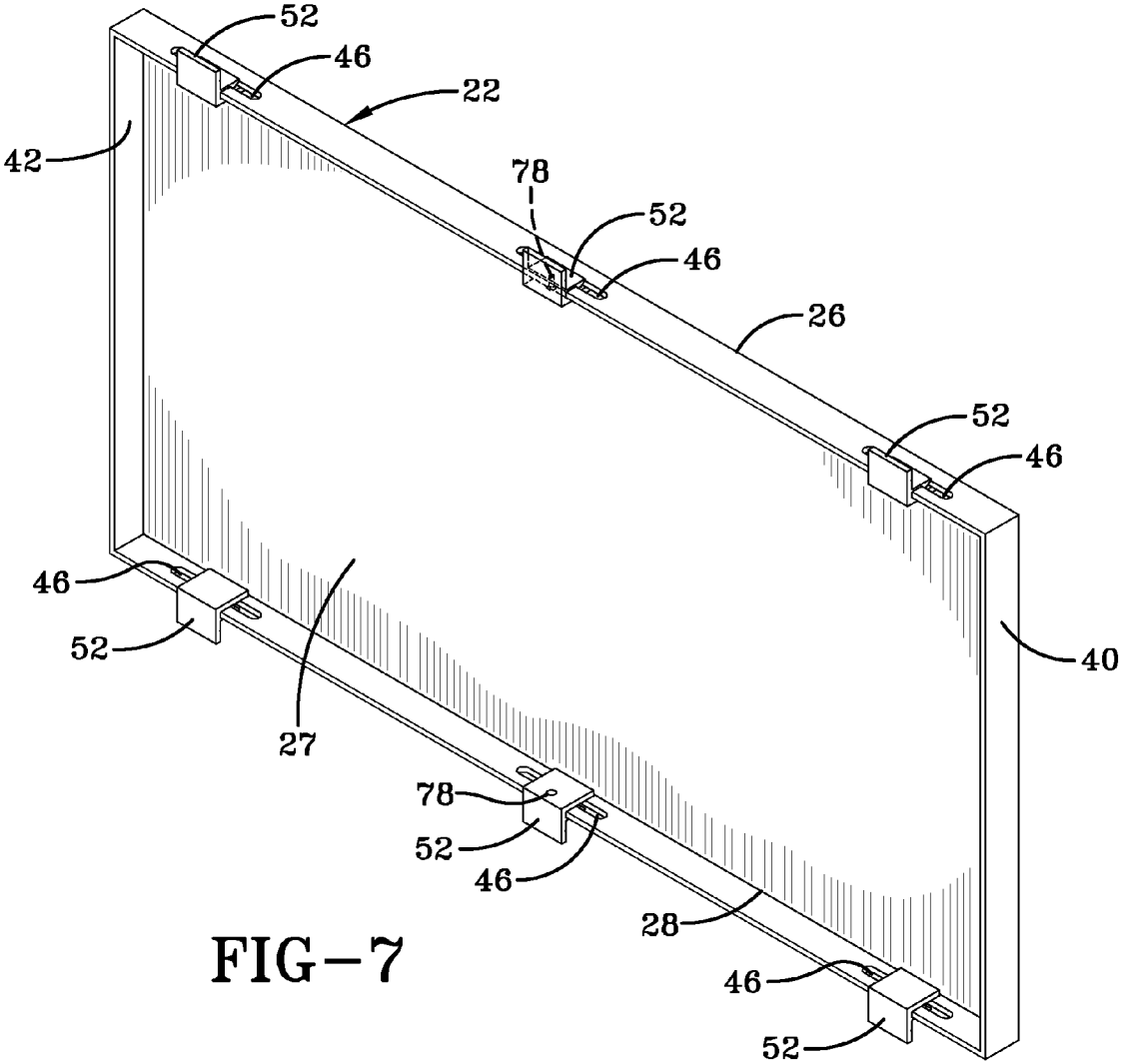
FIG. 7 is a perspective view of a wall panel having clips secured thereto according to the concepts of the present invention.

In one or more embodiments, one clip 52 on each flange attaching wall panel 22 to mounting rail 54 may be secured to the flange of wall panel 22 by a fastener 78, to maintain the proper positioning of wall panel 22 in wall panel system 20, as shown in FIG. 7. The attachment of a single clip 52 on each flange of a wall panel 22 having slots 46 will not prevent thermal cycling, as the other clips 52 will remain free to slide in either direction within slots 46, but the single attachment point 78 will maintain proper spacing and placement of wall panels 22 in relation to other wall panels in wall panel system 20. In at least one embodiment a fastener 78 is provided to attach a center clip 52 on each flange having clips 52, so that expansion and contraction may occur in either direction away from the attached center clip 52. In one or more embodiments, clips 52 may be staggered along the joint between adjacent wall panels. This may be necessary where clips 52 from adjacent panels would otherwise extend into the same area within gaps 25. In order to allow for such staggered attachment, opposing flanges of wall panels 22 may be provided with slots 46 in complimentary locations.

With reference back to FIG. 2, it can be seen that clips 52 secure wall panel 22 to mounting rail 54. Clips 52 can be attached to mounting rails 54 as shown, or alternatively directly to building surface 24, by a fastener 77 extending through fastening plate 68 and planar surface 56. Fastener 78 is preferably a self-drilling screw so that no pre-drilling is required during installation of wall panel system 20. Once wall panels 22 have been secured to building surface 24 by clips 52 and mounting rails 54, a sealant 80 (FIG. 2) may be provided in gaps 25 between adjacent panels 22 to prevent air and water infiltration through wall panel system 20. In one or more embodiments sealant 80 may be in the form of silicone.

Various modifications and alterations that do not depart from the scope and spirit of this invention will become apparent to those skilled in the art. This invention is not to be unduly limited to the illustrative embodiments set forth herein.

What is claimed is:

1. An attachment system for a wall panel system having wall panels, the attachment system comprising:

a plurality of holes in flanges of said wall panels;

clips mated with each of said holes, said clips having a generally planar fastening plate with a first extension and a second extension extending therefrom, said first and second extensions spaced from one another by a distance $d_1$, said second extension carrying a latch member that protrudes toward said first extension and is received in one of said holes, said latch member extending from said second extension a distance $d_2$ that is less than $d_1$, wherein said latch member and said second extension form an end surface angled relative to and facing away from said fastening plate said holes being wider than said latch members of said clips to allow for thermal cycling of said wall panel system.

2. The attachment system of claim 1, further comprising a plurality of mounting rails attached to a building surface proximate said flanges in said wall panels, where said fastening plates of said clips are secured to said mounting rails by a fastener.

3. The attachment system of claim 1, where said clips are secured to said flanges of said wall panels without the use of mechanical fasteners.

4. The attachment system of claim 1, where said second extension is flexible and resilient to allow the clip to be inserted over the flange of the wall panel.

5. A wall panel system for attachment to a building surface, the wall panel system comprising a wall panel having two opposing flanges extending from opposing edges of the panel;

at least one slot in each of said flanges;

a clip mated with each of said slots, said clips having two extensions laterally spaced from one another by a distance $d_1$ creating a gap, one of said extensions carrying a latch member that protrudes toward the other of said extensions and into said gap a distance $d_2$ that is less than $d_1$, said latch member having an angled end surface relative to and facing away from said fastening plate;

wherein said wall panel is attached to a surface by said clips mated with said slots in said flange, said latch members extending into said slots to secure said clips to said flange, and wherein said slots are wider than said latch members of said clips to allow for thermal expansion of said wall panel.

6. The wall panel system of claim 5, wherein flanges extend from four edges of the wall panel.

7. The wall panel system of claim 5, further comprising a mounting rail attached to said surface, where said clips are secured to said mounting rail by a fastener.

8. The wall panel system of claim 7, further comprising shims positioned between the building surface and said mounting rail.

9. The wall panel system of claim 5, wherein said clips are directly secured to the building surface by a fastener.

10. The wall panel system of claim 5, wherein said clips are mated with said slots in said flange without the use of a fastener.

11. The wall panel system of claim 5, wherein a plurality of said wall panels are positioned adjacent to one another and have a gap therebetween.

12. The wall panel system of claim 5, wherein a sealant is provided in said gap between adjacent wall panels.

* * * * *